US006119808A

United States Patent [19]

Steedman et al.

[11] Patent Number: 6,119,808

[45] Date of Patent: Sep. 19, 2000

[54] TRANSPORTABLE ACOUSTIC SCREENING CHAMBER FOR TESTING SOUND EMITTERS

[76] Inventors: James B. Steedman; Hans J. Forschner, both of 701 W. Las Palmas Dr., Fullerton, Calif. 92835

[21] Appl. No.: 09/136,180

[22] Filed: Aug. 19, 1998

Related U.S. Application Data

[60] Provisional application No. 60/056,600, Aug. 20, 1997.

[51] Int. Cl.[7] ..... E04B 1/82

[52] U.S. Cl. ..... 181/295; 181/198; 181/200; 181/202; 181/203; 181/204; 181/290

[58] Field of Search ..... 181/198, 200, 181/202, 203, 204, 290, 295, 30

[56] References Cited

U.S. PATENT DOCUMENTS

| | | | |
|---|---|---|---|
| 2,657,609 | 11/1953 | Stroback | 84/453 |
| 3,652,360 | 3/1972 | Hartman et al. | 156/244 |
| 3,694,974 | 10/1972 | Eckel | 52/36 |
| 3,730,121 | 5/1973 | Supernaw | 114/20 |
| 3,923,119 | 12/1975 | Frye | 181/0.5 |
| 4,051,917 | 10/1977 | Grundmann | 181/200 |
| 4,095,057 | 6/1978 | Power et al. | 179/175.1 A |
| 4,357,499 | 11/1982 | Bruel | 179/175.1 A |
| 4,362,222 | 12/1982 | Hellstrom | 181/30 |
| 4,366,882 | 1/1983 | Parker | 181/30 |
| 5,293,010 | 3/1994 | Archambault et al. | 181/179 |
| 5,407,330 | 4/1995 | Rimington et al. | 417/312 |
| 5,430,070 | 7/1995 | Kono | 521/69 |
| 5,504,281 | 4/1996 | Whitney et al. | 181/286 |
| 5,884,436 | 3/1999 | Ebbitt | 52/79.4 |

FOREIGN PATENT DOCUMENTS 1497361 7/1989 U.S.S.R. .

*Primary Examiner*—Bentsu Ro
*Assistant Examiner*—Edgardo San Martin
*Attorney, Agent, or Firm*—Robert D. Fish, Esq.; Fish & Associates, LLP.

[57] ABSTRACT

An acoustic testing device is relatively small enough and light enough to be transported from business to business and room to room, and yet still has acoustic characteristics sufficient to characterize a test item's noise profile in a relatively short period of time. The device preferably achieves this result by providing inner and outer housings coupled through noise and vibration isolation, the inner housing having at least some mutually non-orthogonal walls, and the sound detection apparatus comprising spatially translating microphones.

14 Claims, 2 Drawing Sheets

TRANSPORTABLE ACOUSTIC SCREENING CHAMBER FOR TESTING SOUND EMITTERS

This application claims benefit to U.S. provisional application No. 60/056,600 filed Aug. 20, 1997.

FIELD OF THE INVENTION

The field of the invention is acoustic screening.

BACKGROUND

All mechanically moving objects emit sound at various frequencies, and acoustic screening chambers are known which can measure the sound intensities produced. Such measurements can be important as a research tool, as well as being used in product design, manufacturing, quality control, diagnostics and troubleshooting. Some examples of products for which sound emission is of current interest are computer disk drives, spindle motors and electronic transformers, all of which are often tested for the amount and frequencies of sound produced.

In general it is desirable to conduct acoustic screening in an environment having (1) a high signal to noise ratio, and (2) either an acoustic free measurement field or an acoustic diffuse measurement field. Acoustic free fields can be simulated in an anechoic or semi-anechoic chamber. Acoustic diffuse measurement fields can be simulated in a reverberation chamber. To achieve a high signal to noise ratio, the chamber is generally constructed with surfaces having a significantly large sound transmission loss. The signal to noise ratio is also related to the size of the chamber (height, width and length) and the sound power emission of the item under test. In the past, chambers simulating acoustic free measurement fields have varied in size from less than one cubic foot to more than twenty five thousand cubic feet, while chambers simulating acoustic diffuse measurement fields have typically been significantly greater than five hundred cubic feet and often times greater than 8,0000 cubic feet.

Previously known acoustic diffuse chambers thus suffer from inconvenient size. This problem has been addressed, but only at the cost of incurring additional problems. U.S. Pat. No. 4,051,917 to Grundmann, for example, addresses the excess size problem by including a sound-dampening liquid in the walls. While somewhat effective in reducing the overall size of the sound chamber, the use of liquid containing walls presents additional problems such as excessive weight and potential leakage. Another problem encountered in reducing chamber size is difficulty in providing accurate measurements. The amount of sound detected is always a function of the relative positions of the sound emitting object and the microphone, and this problem is exacerbated in small chambers. It is known to address this problem through the use of multiple microphones, but many microphones may be needed to provide adequate spatial averaging. Other problems may not be resolved due to acoustical standing waves within the chamber.

Thus, a need still exists to provide a small-sized, readily transportable, acoustic diffuse sound chambers, which nevertheless provides adequate acoustic characteristics for testing the amount and frequencies of sound generated by sound emitting devices.

SUMMARY OF THE INVENTION

The present invention provides a sound measurement apparatus that is small enough to be conveniently transported from business to business and room to room, yet still have adequate acoustic characteristics for testing the amount and frequencies of sound generated by sound emitting devices. This is accomplished by providing an acoustic testing device in which the sound chamber has significant noise and vibration transmission loss, and an acoustic environment simulating a diffuse measurement field. The sound chamber is preferably constructed of an inner and outer housing coupled through a noise and vibration isolation coupling such as a spring and sound absorptive material, the inner housing has at least some mutually non-orthogonal walls, and the sound detection apparatus comprises spatially translating microphones.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
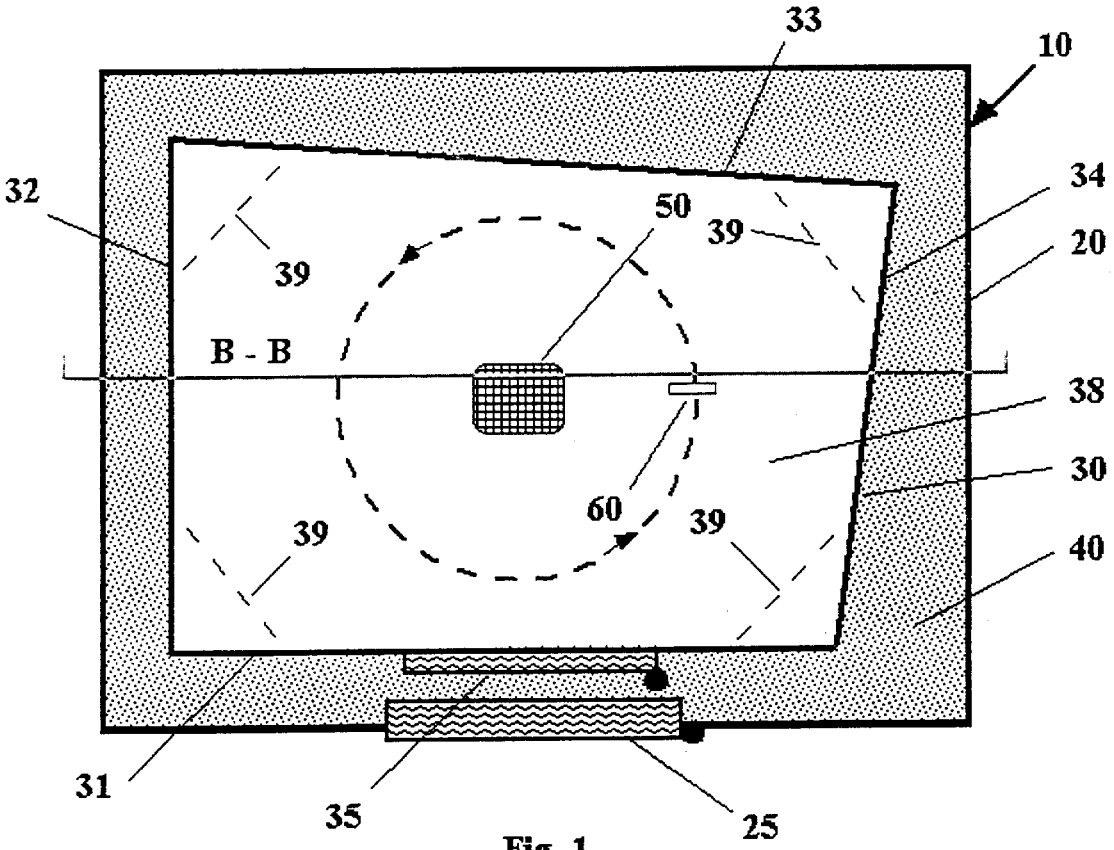
FIG. 1 is a horizontal cross-section of an acoustic testing preferred device according to the present invention.

In a preferred embodiment depicted in horizontal cross-section in FIG. 1, an acoustic testing device 10 generally comprises an outer housing 20 and an inner housing 30 separated by a sound-absorbing material 40. Doors 25, 35 provide access through the outer housing 20 and inner housing 30, respectively, and these doors can also be padded with a sound absorbing material. A test item 50 is generally placed in approximately the middle of the inner housing 30, and sound emitted by the test item 50 is detected by one or more translating microphones 60.

The acoustic testing device 10 is advantageously fabricated to be conveniently transported from business to business, and from room to room. To that end the outer housing preferably has a greatest vertical height measuring less than about 72 inches, and a greatest horizontal length measuring less than 72 inches. In more preferred embodiments, these measurements are less than about 60 inches. Using an alternative measuring scheme, device 20 preferably has a greatest horizontal perimeter or circumference measuring less than 300 inches, with the maximum perimeter of more preferred embodiments measuring less than about 270 inches, and the maximum perimeter of still more preferred embodiments measuring less than about 225 inches. Preferred embodiments are also light enough to be carried by two persons, and especially preferred embodiments weigh less than about 150 pounds.

As used herein, the term "substantially orthogonal" refers to sections that adjoin at an approximately 90 degree angle. The term "substantially non-orthogonal" refers to the converse, i.e., sections that adjoin at some angle other than approximately 90 degrees. Preferred embodiments have at least some substantially non-orthogonal walls, and such walls advantageously are mutually non-orthogonal by at least 5 degrees, more preferably by at least 10 degrees, and still more preferably join at an angle of between approximately 5 degrees and approximately 15 degrees.

Also as used herein, the term "walls" should be interpreted broadly to mean sound reflecting surfaces, whether or not such surfaces have supporting or containing functions.

In the particular embodiment of FIG. 1, two of the side walls 31, 32 of the inner housing 30 are depicted as being orthogonal to one another, while the other two side walls 33, 34 are depicted as being non-orthogonal to the remaining walls. In other embodiments contemplated herein there may be as few as three side walls, or more than four side walls, and more or less than two of the side walls may be non-orthogonal to the others. In alternative embodiments the ceiling and floor (see FIG. 2) of the inner housing 30 may also be non-orthogonal to one or more of the side walls.

Also in alternative embodiments, an acoustic testing device according to the inventive principles herein may have one or more additional housings. Thus, for example, it is contemplated that a testing device may provide an intermediate housing between the inner and outer housings, or a shroud of some sort positioned about the item under test.

The sound absorbing material 40 can advantageously comprise one or more of the commercially available sound-absorbing foams, but need not comprise a known material, and need not comprise a foam. It is, however, contemplated that the sound-absorbing material can be substantially solid or semi-solid as opposed to a liquid.

It is preferred that the overall sound absorbency is high. It is contemplated, for example, that the transmission loss from a point inside the chamber 38 to a point outside the chamber 38 will be greater than about 15 dB, and more preferably greater than about 20 dB. In still more preferred embodiments, such transmission loss will be at least 30 dB or even at least 40 dB. These high transmission losses can be achieved through sufficient thickness of sound absorbing material 40.

The doors 25, 35 need not be positioned as shown on FIG. 1. In alternative embodiments, for example, doors 25,35 can be positioned in the roof of housings 20, 30. It is also contemplated to have no inner housing door at all, but instead to access the space within the inner housing by removing the inner housing from the outer housing.

The walls (such as walls 31, 32) of inner housing 30 are advantageously fabricated to have a surface structure that provides reflectivity of at least 85%. More preferably, the reflectivity is at least 90% (0.90), still more preferably at least 93% (0.93) and most preferably at least 95% (0.95). Flat steel walls often satisfy these parameters, and may typically provide reflectivity of between about 93% and about 95%. Such measurements are taken at the frequencies of interest, which are considered herein to be those normally considered to be within human hearing range, about 300 Hz to about 20 KHz.

Figure 2:
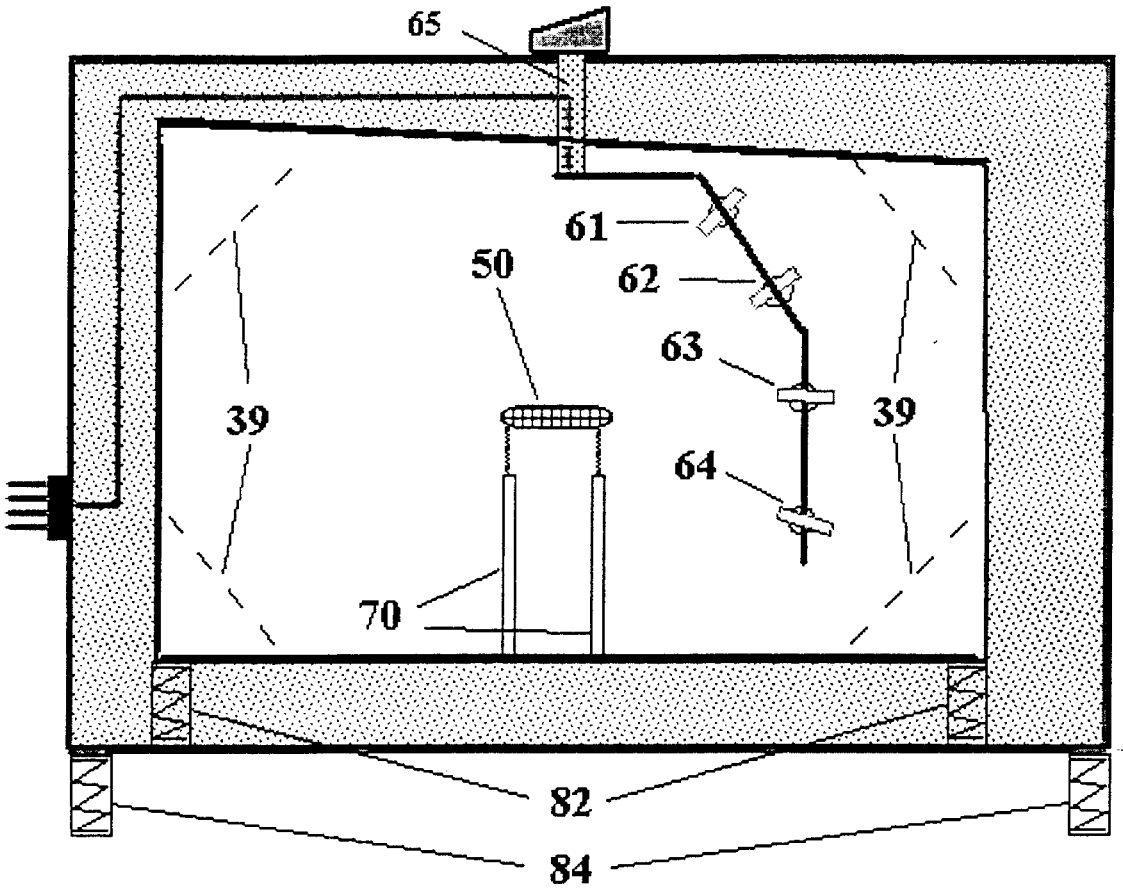
FIG. 2 is a vertical cross section of the acoustic device of FIG. 1 at B—B.

Turning to FIG. 2, it is seen that the sound detection apparatus can comprise more than one microphone, and in this case four microphones 61, 62, 63 and 64. One or more of these microphones can advantageously be positionally translated by rotation using boom assembly 65. The boom assembly 65 is contemplated to allow significant spatial translation of the carried microphones, and preferably may spatially translate such microphones at least 25, 30, 36, 40 inches or even more during a testing cycle. Also seen in FIG. 2 are supports 70 for the item to be tested 50, and vibration isolation mounts 82, 84 which support the inner housing 20 and outer housing 30, respectively.

As described above, the inventive subject matter is not limited to that depicted in the Figures, and many alternative embodiments are contemplated. For example, the microphones 61,62,63 and 64 are all depicted as pointing towards the item under test 50, but in alternative embodiments one or more of the microphones could be pointed in other directions instead. It is contemplated that the boom assembly may consist of one or more booms, each with one or more microphones attached to each boom. It is also contemplated that the directional pointing of one or more of the microphones could vary over the course of the testing. For example, one or more of the microphones may both translate and rotate.

With respect to vibration isolation, it is contemplated that the spring based vibration isolation system using springs 82, 84 could be or replaced by one or more alternative sound-isolation coupling devices. For example, springs (not shown) could be used to suspend the inner housing from above or from the sides of the outer housing, rather than support it from below. It is also contemplated that pneumatic or other pistons could be employed in place of the vibration isolation mounts. Thus, it is contemplated that the vibration isolation system could comprise one or more of a viscoelastic, a pneumatic, a hydraulic and a spring mounting system.

With respect to the noise isolation system, it is contemplated that noise reducing systems other than foam can be employed. For example, the foam could be replaced by a glass fiber or some other sound absorbing material. Also, the testing chamber 38 may be partially evacuated of air, or alternatively the air could be replaced with another gas. Also, the walls, ceiling and floor of the testing chamber 38 need not be flat. Such walls may, for example, be wavy or have projections, and the corners may have additional reflective surfaces 39.

Thus, specific embodiments and applications of acoustic screening methods and apparatus have been disclosed. It should be apparent, however, to those skilled in the art that many more modifications besides those already described are possible without departing from the inventive concepts herein. The inventive subject matter, therefore, is not to be restricted except in the spirit of the appended claims.

What is claimed is:

1. A reverberation type acoustic testing device that detects sound emission from a test object, comprising:

an outer housing having a greatest horizontal perimeter measurement less than about 300 inches;

an inner housing having an acoustic diffuse measurement sound chamber with at least two walls that are mutually non-orthogonal by at least 5 degree, the inner housing coupled to the outer housing through a noise isolation system and a vibration isolation system; and a sound detection apparatus disposed within the inner housing, and having at least one spatially translating microphone.

2. The device of claim 1 wherein device weighs less than 150 pounds.

3. The device of claim 1 wherein the outer housing has a greatest horizontal length measuring less than 72 inches.

4. The device of claim 1 wherein the greatest horizontal perimeter measurement is less than 270 inches.

5. The device of claim 1 the greatest horizontal perimeter measurement is less than 225 inches.

6. The device of claim 1 wherein the two at least walls are mutually non-orthogonal by at least 10 degrees.

7. The device of claim 1 wherein at least one of the two at least walls has a reflectivity of at least 90% in a frequency between about 300 Hz and about 20 kHz.

8. The device of claim 1 wherein at least one of the two at least walls has a reflectivity of at least 93% in a frequency between about 300 Hz and about 20 kHz.

9. The device of claim 1 wherein at least one of the at least spatially translating microphones travels at least 36 inches during a testing cycle.

10. The device of claim 1 wherein the vibration isolation system comprises at least one of a viscoelastic, a pneumatic, a hydraulic and a spring mounting system.

11. The device of claim 1 wherein the noise isolation system comprises at least one of a glass fiber and a foam.

12. The device of claim 1 further comprising a sound transmission loss between a position outside of the chamber and a position inside of the chamber is greater than 20 dB.

13. The device of claim 1 wherein the outer housing has a greatest length, height and width measurement of less than 72 inches, the two walls are mutually non-orthogonal by at least 10 degrees, and at least one of the at least spatially translating microphones travels at least 36 inches during a testing cycle.

14. The device of claim 1 wherein the inner housing has a greatest length, height and width measurement of less than 65 inches, and two of the walls are mutually non-orthogonal by at least 10 degrees, and at least one spatially translating microphone is mounted on a boom which rotates during a testing cycle.

* * * * *